US007497053B2

(12) United States Patent
Nicolet

(10) Patent No.: US 7,497,053 B2
(45) Date of Patent: Mar. 3, 2009

(54) SYSTEM FOR FIXING AN OBJECT IN THE GROUND BY MEANS OF A PEG

(76) Inventor: André Nicolet, Chemin du Château, 93, B-4970 Stavelot (BE)

( * ) Notice: Subject to any disclaimer, the term of this patent is extended or adjusted under 35 U.S.C. 154(b) by 352 days.

(21) Appl. No.: 10/573,638

(22) PCT Filed: Sep. 27, 2004

(86) PCT No.: PCT/EP2004/052330

§ 371 (c)(1),
(2), (4) Date: Mar. 27, 2006

(87) PCT Pub. No.: WO2005/031091

PCT Pub. Date: Apr. 7, 2005

(65) Prior Publication Data

US 2007/0017166 A1 Jan. 25, 2007

(30) Foreign Application Priority Data

Sep. 26, 2003 (EP) ..... 03103579

(51) Int. Cl.
*E02D 5/74* (2006.01)
*F16B 13/06* (2006.01)
*F16B 15/00* (2006.01)
*F16M 13/00* (2006.01)

(52) U.S. Cl. ..... 52/161; 52/156; 52/714.15; 411/359; 411/22; 248/545; 405/259.1

(58) Field of Classification Search ..... 52/115, 52/153, 154, 155, 156, 160–161, 165, 166, 52/741.11, 741.14, 741.15; 248/85, 87, 156, 248/508, 530.545; 405/244, 249, 250, 251, 405/252.1, 253, 255; 411/358, 359, 21, 22
See application file for complete search history.

(56) References Cited

U.S. PATENT DOCUMENTS 362,183 A * 5/1887 Runyon ..... 52/162

(Continued)

FOREIGN PATENT DOCUMENTS

DE 3223302 A1 * 12/1983 ..... 411/21
WO WO 01/42569 6/2001

OTHER PUBLICATIONS

International Search Report; PCT/EP2004/052330; Dec. 13, 2004.

*Primary Examiner*—Robert J Canfield
*Assistant Examiner*—Brent W Herring
(74) *Attorney, Agent, or Firm*—Cantor Colburn LLP

(57) ABSTRACT

The invention relates to a system for fixing an object in the ground, comprising at least one fixing peg (10) and means for carrying out the above. The peg (10) comprises a tube (14) and at least two lugs (28) on the lower end of a central support rod (24). An axial tension acting on the rod (24) which runs axially in the tube (14) and is fixed in rotation therein, causes the lugs (28) to deploy through openings (30) in the tube (14), such as to cause the extension thereof in the direction of tension at an angle to the length of the tube (14). An operating mechanism (33) comprises a threaded pin (36) with a screw (40) pressing on the head of the tube. The lower end of said threaded pin (36) is coupled to the upper end of the central support (24) in order to transmit an axial tension thereto on turning the screw (40) in a first direction.

17 Claims, 4 Drawing Sheets

U.S. PATENT DOCUMENTS

| | | | | | |
|---|---|---|---|---|---|
| 697,031 | A | * | 4/1902 | Snook | 52/160 |
| 772,515 | A | * | 10/1904 | Jackman | 52/162 |
| 791,373 | A | * | 5/1905 | Shaffer | 411/359 |
| 828,509 | A | * | 8/1906 | Rounsburg | 52/160 |
| 958,127 | A | * | 5/1910 | Hovrud | 52/160 |
| 1,169,635 | A | * | 1/1916 | Grimes | 411/344 |
| 1,606,147 | A | * | 11/1926 | Cole et al. | 52/161 |
| 1,703,461 | A | * | 2/1929 | Thomas | 52/161 |
| 1,796,147 | A | * | 3/1931 | Green et al. | 52/161 |
| 1,907,811 | A | * | 5/1933 | Hollos | 52/156 |
| 2,366,997 | A | * | 1/1945 | Brand | 52/160 |
| 2,576,412 | A | * | 11/1951 | Ogburn | 52/161 |
| 2,588,712 | A | * | 3/1952 | Ferris | 52/161 |
| 3,011,597 | A | * | 12/1961 | Galloway et al. | 52/154 |
| 3,135,365 | A | * | 6/1964 | Hayhurst | 52/161 |
| 3,507,081 | A | * | 4/1970 | Gallup | 52/103 |
| 3,526,069 | A | * | 9/1970 | Deike | 52/160 |
| 3,552,258 | A | * | 1/1971 | Warner | 411/21 |
| 3,763,655 | A | * | 10/1973 | Galuska | 405/244 |
| 3,803,783 | A | * | 4/1974 | Ballew | 52/161 |
| 3,924,371 | A | * | 12/1975 | Kidwell | 52/161 |
| 4,178,726 | A | * | 12/1979 | Watson | 52/98 |
| 4,403,734 | A | * | 9/1983 | Gorman | 238/372 |
| 4,453,845 | A | * | 6/1984 | Donan, Jr. | 405/259.3 |
| 4,592,178 | A | * | 6/1986 | Lu | 52/155 |
| 4,833,846 | A | * | 5/1989 | McFeetors et al. | 52/154 |
| 5,702,215 | A | * | 12/1997 | Li | 411/21 |

* cited by examiner

SYSTEM FOR FIXING AN OBJECT IN THE GROUND BY MEANS OF A PEG

TECHNICAL FIELD OF THE INVENTION

The present invention relates to a system for anchoring an object in the ground using a peg or stake, used in particular for anchoring land survey bench-marks such as those used by surveyors, posts of all kinds, particularly fence posts and the post part of signposts.

BRIEF DESCRIPTION OF THE RELATED ART

Anchoring stakes for land-survey bench-marks (also known as triangulation pillars) have been known for a very long time in numerous variants. These stakes have to hold bench-marks in the ground for several decades in a way that is reliable in spite of the various kinds of attack that this type of object may experience, such as shifting of the ground, the passage of agricultural vehicles or of livestock. Numerous solutions have already been proposed for increasing the pull-out strength of these stakes. They may be grouped in general into two categories.

The first category of stake uses a fixed-geometry anchoring system. Document U.S. Pat. No. 4,738,760 discloses such a stake for anchoring in the ground a permanent marker identifying an object buried in the ground. The stake comprises a long body terminated at a first end by a striking head and at a second end by a plurality of slightly curved elastic fins arranged radially and facing toward the outside of the stake in the direction away from the spike so as to form a kind of barbed hook. When the stake is driven into the ground, the elastic fins bend back along the body under the thrust of the soil displaced by the penetration of the stake. If the stake subsequently experiences traction, the elastic fins deploy because their slightly curved part has a tendency to anchor itself in the surrounding ground under the effect of the elastic return force of the elastic fins. Unfortunately, real life has shown that these barbed hooks have a limited effect, especially one that is dependent on the nature of the ground. Quite often, the ground compacted in the region of the elastic fins as the barbed hook is driven in prevents these fins from returning elastically, which means that the fins offer practically no resistance to the pulling-out of the stake.

The second category of stake envisages deployable elements. In document EP 0 677 630 B1, such a stake has a longitudinal body of tubular cross section containing deployable elements. The stake is driven first of all into the ground, then a long rod ending in a mandrel is placed inside its tubular cross section. This rod comes to bear against the deployable elements and forces them out from the body of the stake through guide orifices when the mandrel is subjected to substantially axial thrust. The carefully sized guide orifices and the ground curve the deformable elements as they deploy outward in somewhat helical paths. This type of stake is currently the one most widely marketed among anchoring products for surveying, but nonetheless has certain disadvantages. The deformable elements generally position themselves in the axial continuation of the stake and in the same direction as the force needed to drive the stake in. This geometry does not have optimum pull-out strength capabilities. Specifically, if traction is exerted on the stake, the deployable elements have a tendency to yield. It should also be noted that a stake pulled out of the ground is theoretically no longer useable.

Document WO 01/42569 shows, in FIGS. 17 and 18, an anchoring stake comprising a tube with two deployable blades by way of anchoring elements. The blades are mounted with one end on a nut which can be moved axially inside the tube. Their free end passes through a slot in the side wall of the tube. A bolt engages with the nut in the tube and its head bears against a closed head of the tube. Once the anchoring stake has been driven into the ground, the bolt is turned in such a way as to cause the nut to move upward, thus forcing the anchoring blades to penetrate the slots into the ground as they extend upward at an angle along the tube. It will be noted that this anchoring stake has the advantage of offering better pull-out strength. However, the head of the bolt, which projects from the closed head of the tube, is a great impediment to driving the anchoring stake into the ground.

FIGS. 20 and 21 of document WO 01/42569 show an embodiment variant which no longer has the aforementioned disadvantage of the anchoring stake of FIGS. 17 and 18. This anchoring stake comprises a tube and a body in the form of a U serving as an anchoring element. A threaded rod with a special head serves as a tool for the placement of the anchoring element. The tube is driven into the ground without the anchoring element. The U-shaped body is then mounted on the threaded rod. To do this, a transverse head of the threaded rod is passed through a slot in the base of the U-shaped body and the threaded rod is turned through 90°. Using the threaded rod, the U-shaped body is driven into the tube until its lateral arms engage with canals formed in the side wall of the tube. A nut screwed on to the threaded rod allows the U-shaped body to be pushed into the tube. Once the lateral arms have engaged in the canals formed in the side wall of the tube, traction is exerted on the threaded rod, either using a lever or using a tightening nut which is wound down on to a spacer piece. This traction forces the lateral arms of the U-shaped body to penetrate the ground through the canals in the side wall of the tube. When this operation has been completed, the threaded rod is turned through 90° in order to pass its head through the slot in the base of the U-shaped body so that the threaded rod can be withdrawn from the tube. It will be noted that the subsequent operation of placement of the U-shaped anchoring body in the tube is a very tricky one.

Finally, it should be noted that the anchoring stakes described in document WO 01/42569 are designed to serve as permanent anchors for posts. Once anchored in the ground, they theoretically remain in situ. Now, for certain applications, particularly for securing land-survey bench-marks, it is also important to be able easily to recover the anchoring stake if it is no longer used.

BRIEF SUMMARY OF THE INVENTION

The invention proposes a system for anchoring an object in the ground using an anchoring stake that offers good pull-out strength, allows easy placement of the anchoring stake, and easy recovery of the latter if it is no longer in use.

Such a system for anchoring an object in the ground comprises at least one anchoring stake and an actuating mechanism. The anchoring stake comprises a tube and at least two deformable anchoring claws mounted on a claw support which can move axially inside the tube. The tube has a tube wall, a drive-in spike and a head. The anchoring claws are mounted with one end on the claw support such that axial traction exerted on the claw support in the opposite direction to said drive-in direction causes the claws to deploy out from the tube through openings in the tube wall. These openings have a geometry such that they cause the anchoring claws to deploy at an angle along said tube in the direction of traction. The actuating mechanism is a mechanism involving a threaded rod. An anchoring stake of the system according to the invention further comprises the following characteristics. The claw support comprises a central support rod which is coaxial with the tube, axially guided and prevented from rotating in the tube. The claws are borne by the lower end of this central support rod at the drive-in spike end. At the tube head end, a coupling means is fitted to the upper end of the central support rod. The actuating mechanism involving a threaded rod comprises a nut able to bear against the tube head and a threaded rod on to which said nut is screwed, and the lower end of which comprises a coupling means able to collaborate with the coupling means of the upper end of the central support rod so as to transmit said axial traction to this upper end when said nut is turned in a first direction.

It will first of all be appreciated that an anchoring stake of the system according to the invention provides good pull-out strength. Specifically, the direction in which the claws are deployed directly opposes the extraction force, making it possible in this way to obtain optimum pull-out strength. As the claws are inside the stake while the stake is being driven in, any deformation or breakage of the claws is precluded. In addition, once the stake has been driven in, the claws can deploy into a medium that has not been weakened by the driving-in of the stake. Quite to the contrary, the driving-in of the stake will have locally compacted the medium surrounding the stake. This compacted medium offers a very firm purchase in which to anchor the claws.

It will then be appreciated that, with the system according to the invention, the placement of the stake in the ground is particularly simple. Specifically, the stake can be driven into the ground without fitting the actuating mechanism. During this driving operation, the central claw support rod is completely retracted within the tube, which means there is no element projecting with respect to the tube head that might impede the driving-in of the anchoring stake by blows applied to the tube head. Once the stake has been driven into the ground, the actuating mechanism can be coupled to the central claw support rod. To do this, all that is required is for the lower end of the threaded rod to be coupled to the upper end of the central claw support rod. This is a very easy operation because coupling is done near the tube head. To deploy the claws, the nut bearing against the tube head is then turned in said first direction, causing the central claw support rod to move upward. When the claws have been deployed, the actuating mechanism can be removed and used to anchor other stakes. The re-use of the actuating mechanism naturally reduces the costs of the system.

It will also be appreciated that the recovery of a stake anchored in the ground is also very easy. In order to free the anchor, it is necessary for example merely to strike the upper end of the central claw support rod, thus causing the central claw support rod to drop and consequently causing the claws to retract into the tube. The axial guidance of the central claw support rod will make this operation easier by preventing the claws from jamming in the tube.

If the risk of damage to the claws when recovering a stake anchored in the ground is to be reduced still further, use is advantageously made of an actuating mechanism which further comprises a locking means that can be connected to the tube head in such a way as to form a backstop for the nut when the latter is turned in a second direction, the opposite to the first, in order thus to cause a translational movement of said threaded rod toward the inside of the tube and cause said claws to retract back inside the tube. The locking means is advantageously an element that can be connected removably to the tube head. In a preferred embodiment, the actuating nut comprises a base, the tube head comprises a collar and the locking means is a stirrup piece positioned straddling the base and the collar.

The coupling means advantageously form a coupling with a helical connection or a bayonet connection. These are couplings that allow for quick coupling and uncoupling and do not demand a great deal of space, that is to say do not require an increase in the cross section of the tube.

The anchoring claws are preferably deformable rods which, when compared to anchoring blades, take up less space in the retracted position and penetrate the ground better.

In a particularly compact embodiment of the anchoring stake, the tube has a square cross section, the central support rod has a round cross section and the anchoring claws are deformable rods of round cross section which are arranged in the four corners of the square-section tube and which pass through openings arranged in the corners of the wall of the tube.

The tube wall comprises openings through which the claws deploy at different heights. In this way, the anchoring claws deploy into the ground at different depths. In the case of terrain of a very heterogeneous density, the chances that some claws will be able to deploy into a mechanically stable region are thus increased. The anchoring claws are also advantageously borne by a plate fixed to the lower end of the central support rod and have different lengths.

To guarantee good axial guidance, axial guidance of the lower and upper ends of the central support rod in the tube is advantageously provided. Good axial guidance is actually essential to avoiding deformation of the claws when, in order to retract the claws, the upper end of the central claw support rod is struck.

In order to ensure better immobilization of the anchoring stake in the ground, means for firming the ground around the tube are advantageously provided at the head end of the tube. Such ground-firming means comprise, for example, a body in the form of an inverted cone or of an inverted pyramid, this body having the tube passing axially through it. Such a ground-firming body is advantageously formed of two half-bodies assembled around the tube along a plane that passes through the axis of the tube. It should then be noted that the ground-firming means may also comprise at least two T-sections which extend at an angle along the upper part of the tube so as to form a "V".

In order to make placement and recovery of an anchoring stake easier still, the means for employing the anchoring stake advantageously comprise a mandrel equipped with a shoulder able to bear against a collar surrounding the tube head in order to drive the tube into the ground, and equipped with a central rod with a flexible end able to bear against the upper end of the central claw support rod in the tube in order to drive the latter into the tube and thus retract the claws.

It will be appreciated that a system according to the invention is particularly well-suited to anchoring a land-survey bench-mark in the ground.

BRIEF DESCRIPTION OF THE FIGURES

Other specifics and characteristics of the invention will become apparent from the detailed description of a number of advantageous embodiments which are set out hereinbelow by way of illustration with reference to the attached drawings. The latter show.

In the figures, the same references denote elements that are identical or similar.

DETAILED DESCRIPTION OF A PREFERRED EMBODIMENT

Figure 1:
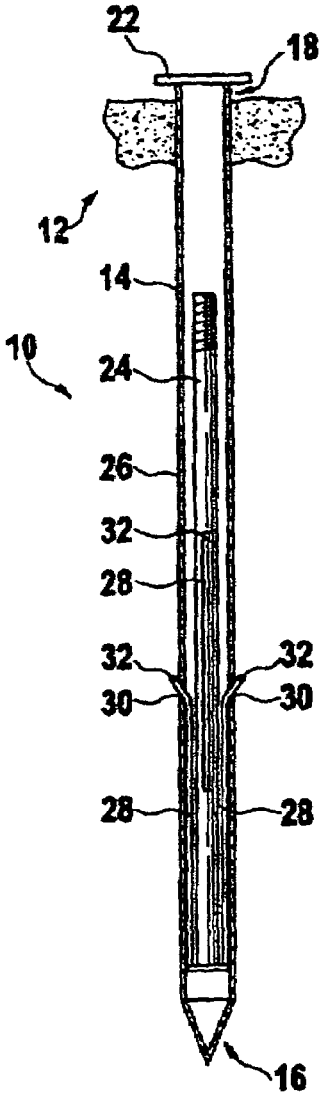
FIG. 1: a schematic view in vertical section of a stake alone once it has been driven into the ground.
Figure 7:
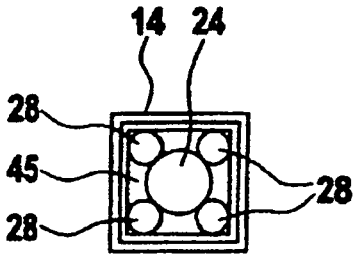
FIG. 7: a schematic view of a stake, from above.

FIG. 1 illustrates a preferred embodiment of a stake 10 according to the invention, the stake 10 being driven into a medium 12, for example ground. The stake 10 comprises a tube 14 having a spike 16 at a first end and being open at its other end 18. The end 18 of the tube 14 is equipped with a head plate 22 (also known as tube head) forming a collar. As can be seen in FIG. 7, the tube 14 has a square cross section in the embodiment depicted.

A central support rod 24 is positioned inside the tube 14. This central support rod 24 is equipped with a plurality of anchoring claws 28 secured at their lower part to the central rod 24. As can be seen in FIG. 1, prior to deployment, the claws are arranged along the rod 24. The anchoring claws 28 are preferably made of flexible steel, but may be made of any other material allowing plastic or elastic deformation of the claws without breakage as they deploy.

The tube 14 comprises, in its side wall 26, a plurality of openings 30. These accommodate the curved upper ends 32 of the anchoring claws 28, which, prior to deployment, do not protrude from the side wall 26 of the tube 14 and are completely housed within the tube 14. It will be pointed out that the curved upper ends 32 and the openings 30 are spaced not only circumferentially around the tube 14 but also axially along the tube 14. The axial distribution of the points at which the claws 28 penetrate the ground increases the chances of firm anchorage by getting around the problem of possible heterogeneity of the medium 12 if the latter exhibits regions of varying looseness at different depths. The number of openings 30 and of anchoring claws 28 may be chosen according to the nature of the medium 12 or of the load that the present invention is to experience.

The first phase of use of the stake 10 is to drive it, using an appropriate tool, such as a mass or a heavy hammer for example, into the ground 12. FIG. 1 shows the stake 10 after this first phase.

Figure 2:
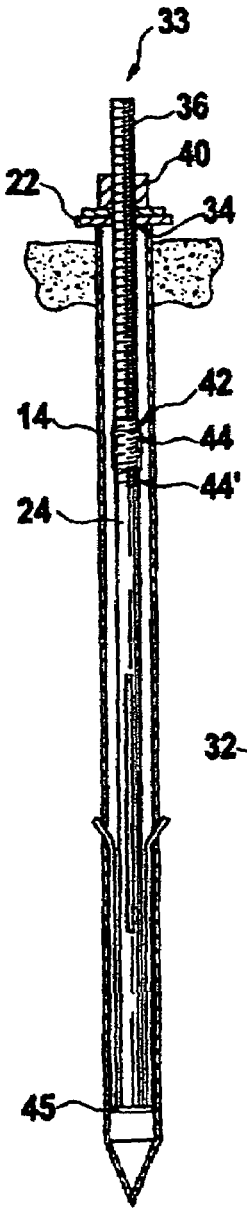
FIG. 2: a schematic view in vertical section of a stake once a device used to deploy the anchoring claws has been fitted.

FIG. 2 illustrates the second phase in the use of the stake 10: the placement of a removable actuating mechanism 33. The actuating mechanism 33 fits on to the head 22 of the tube 14 and comprises a threaded rod 36 and a nut 40. This mechanism is in practice installed as follows. The threaded rod 36 is introduced through an opening 34 in the head plate 22 and the nut 40 is screwed on to this rod. The lower end 42 of the threaded rod 36 has a tapped bore 44 and is screwed on to a threaded end 44' of the central support rod 24, so as to obtain a connection that allows a traction force to be transmitted to the central support rod 24. A possible variant to a helical connection between two threads is, for example, a bayonet-type coupling. However, other coupling variants are not excluded. With reference to FIG. 7 it will be noted that the central rod 24 is prevented from rotating in the tube 14 by means of a square plate 45 fitted into the square section of the tube 14. This plate 45 also serves to axially guide the central support rod 24 in the tube 14. If the tube 14 had a circular cross section, then it would be necessary, for example, to provide inside the tube 14 some form of axial guidance that prevented the plate 45 from rotating. FIG. 7 also shows that the central support rod 24 has a round cross section and that the anchoring claws 28 are deformable rods of round cross section arranged in the four corners of the square-section tube 14 and passing through openings arranged in the corners of the wall 26 of the tube 14. This arrangement makes it possible to work with a tube of small cross section while at the same time being sure that the deployment and retraction of the claws 28 run smoothly.

Figure 3:
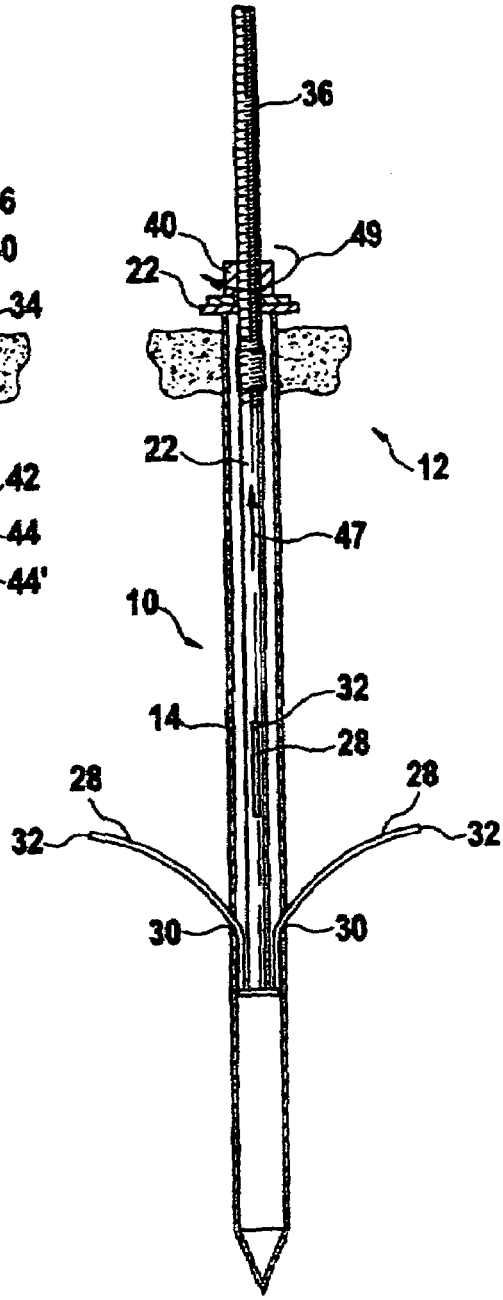
FIG. 3: a schematic view in vertical section of a stake showing the deployment of the anchoring claws.

In order to exert traction on the central support rod 24 in the direction of the arrow 47 of FIG. 3, that is to say in the opposite direction to the direction in which the stake is driven in, the nut 40 bearing against the head plate 22 is turned using a wrench in the direction of the arrow 49. In effect, since the central support rod 24 is prevented from rotating in the tube 14, turning the nut 40 bearing against the head plate 22 in the direction of the arrow 47 causes a translational movement of the central support rod 24 in the direction of the arrow 47, provided of course that the nut 40 and the threaded rod 36 have a right-hand screw thread. As the central support rod 24 executes its translational movement in the direction of the arrow 47, the anchoring claws 28 are pushed through the openings 30 in the tube 14 to penetrate the adjacent ground 12. The lower and upper edges of the openings 30 are chamfered so that the anchoring claws 28 are guided, starting with the curved upper ends 32, at an angle along the tube 14 in the direction of the arrow 47, that is to say in the direction of the traction. The path of the anchoring claws 28 is determined, partly, by the geometry of the openings 30 and, partly, by the resistance to penetration offered by the medium 12. It will be appreciated that, once the claws 28 have been deployed, the stake 10 is firmly anchored in the ground 12 in the manner of a harpoon. Specifically, the anchoring claws 28 then put up optimum resistance to any force that might tend to extract the stake 10 from the ground 12.

Figure 4:
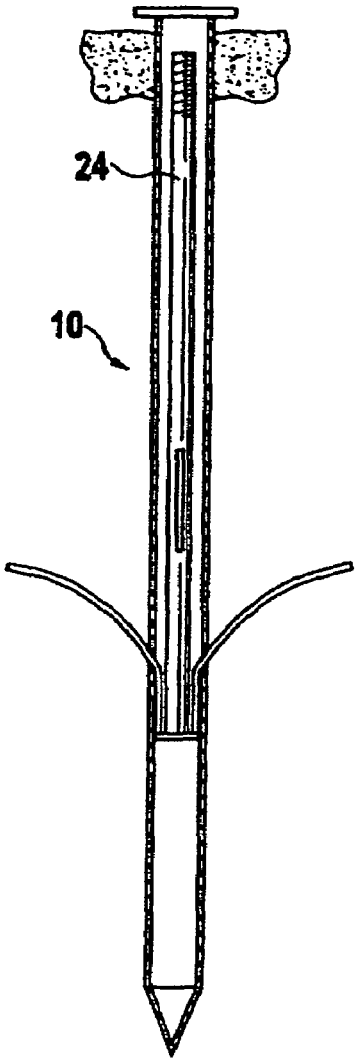
FIG. 4: a schematic view in vertical section of a stake once it has been permanently anchored.

FIG. 4 shows the stake 10 anchored in the ground. The threaded rod 36 has been unscrewed from the central support rod 24 and removed, together with the nut 40.

Figure 5:
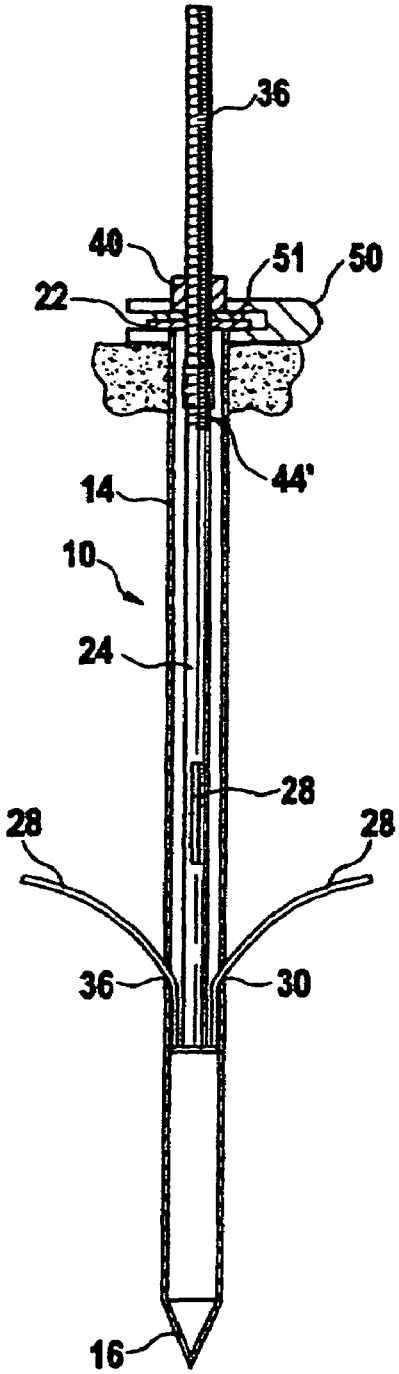
FIG. 5: a schematic view in vertical section of a stake after a device used to retract the anchoring system has been installed.

FIG. 5 illustrates the first phase in recovering the stake 10. The threaded rod 36 is once again screwed on to the threaded end 44' of the central support rod 24 in the same way as in the phase for anchoring the stake 10. The nut 40 is brought closer to the head plate 22 of the tube 14. Next, a stirrup piece 50 is placed straddling the head plate 22 of the tube 14 and a base plate 51 of the nut 40. One leg of the stirrup piece 50 bears against the underside of the head plate 22 and the other leg forms a backstop for the upper face of the base plate 51 of the nut 40. The nut 40 is then turned using a wrench so as to cause the threaded rod 36 to penetrate within the tube 14. Through this translational movement, the central support rod 24 is also made to move translationally toward the spike 16 of the tube 14. In doing so, it forces the anchoring claws 28 to retract through the openings 30 of the tube 14. It will be noted that, in order to drive the central support rod 24 toward the spike 16 of the tube 14, the nut 40 bears against the top leg of the stirrup piece 50, which transmits the reaction to this force to the head plate 22 of the tube 14.

Figure 6:
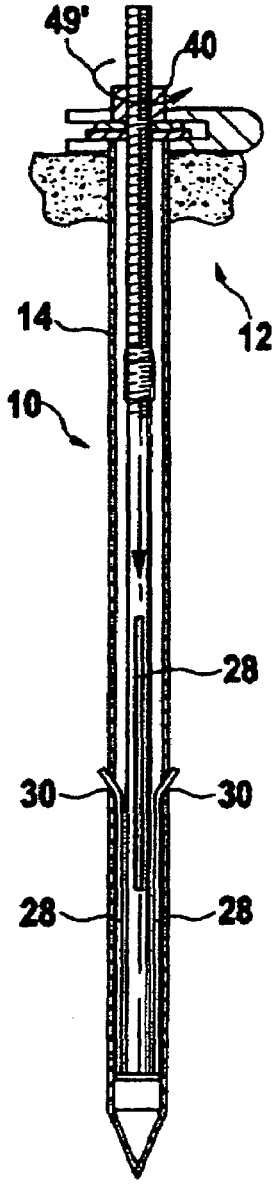
FIG. 6: a schematic view in vertical section of a stake showing the retraction of the anchoring claws.

FIG. 6 shows the anchoring claws 28 fully retracted inside the tube 14 following adequate turning of the nut 40 in the direction of the arrow 49'. The chamfered edges of the openings 30 make it easier for the anchoring claws 28 to retract and prevent them from breaking, so that the stake 10 can be re-used once it has been extracted from the ground 12.

Figure 8:
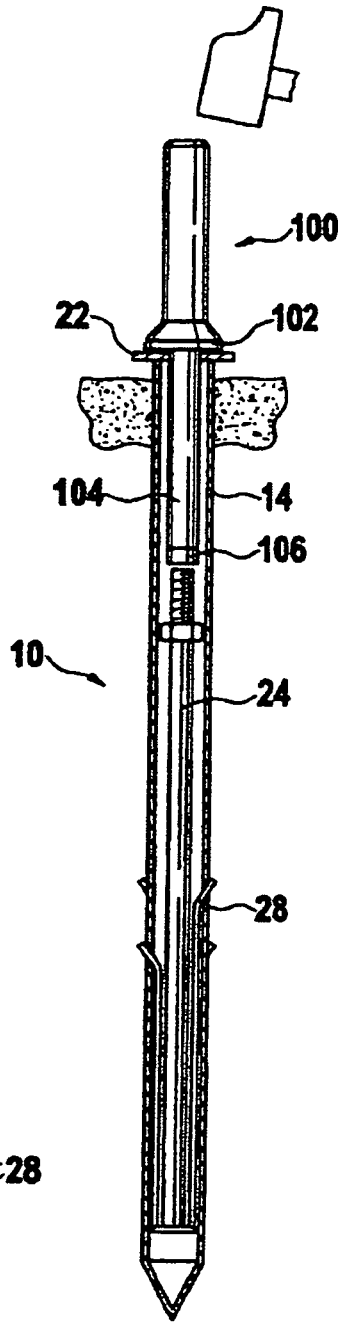
FIG. 8: a schematic view in vertical section of a stake as it is being driven into the ground using a special mandrel.

FIG. 8 illustrates the driving of an anchoring stake 10 into the ground using a special mandrel 100. This special mandrel 100 comprises a shoulder 102 bearing against the head plate 22 of the tube 14 and a central rod 104. The latter penetrates the tube 14 to center the mandrel 100 on the tube 14. It will be noted that, in FIG. 8, the end 106 of the central rod 104 is spaced away from the upper end of the central support rod 24.

Figure 9:
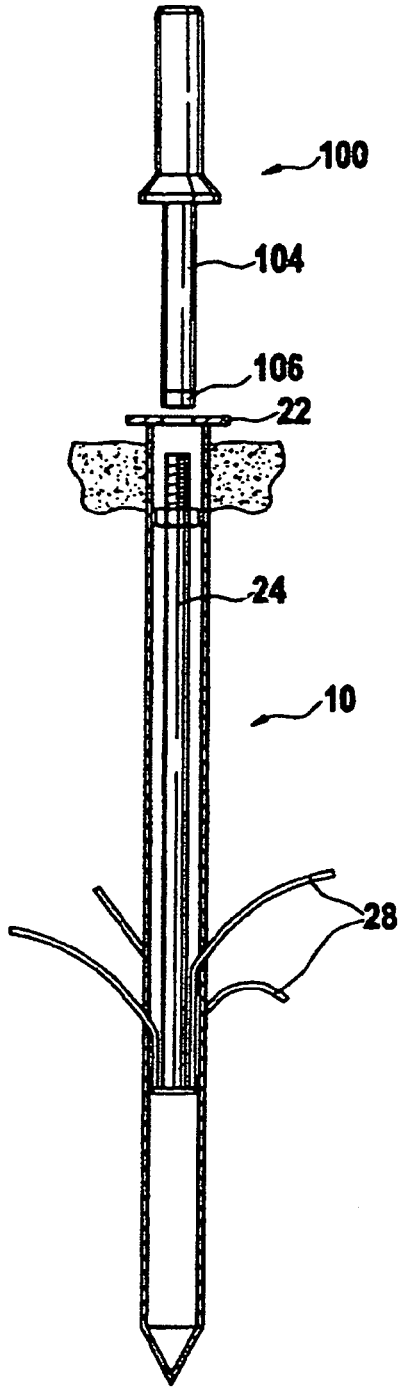
FIG. 9: a schematic view in vertical section of a stake as the claws are being retracted using the special mandrel of FIG. 8.

FIG. 9 illustrates the use of the same mandrel 100 for retracting the claws 28. When the claws 28 are deployed from the tube 14, the upper end of the central support rod 24 is very close to the head plate 22 of the tube 14. The central rod 104 of the mandrel 100 can then bear against the upper end of the central support rod 24 to drive this rod 24 into the tube 14 and thus retract said claws 28. In order not to damage the upper end of the central support rod 24, the end 106 of the rod 104 of the mandrel 100 is advantageously made of a material softer than the upper end of the central support rod 24.

Figure 10:
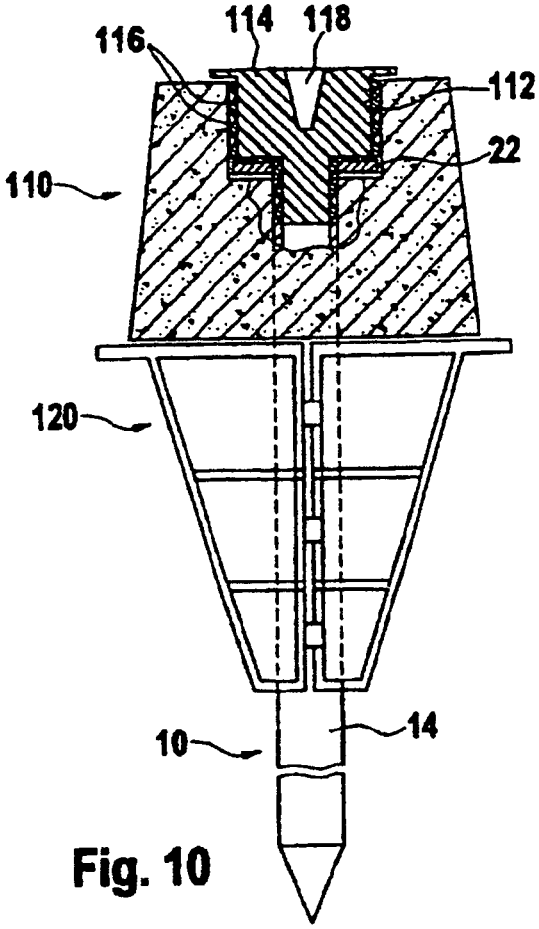
FIG. 10: a schematic view in part section showing the securing of a marker or beacon using an anchoring stake comprising a ground-firming cone.

FIG. 10 shows the securing of the top of a marker 110 using an anchoring stake 10. The marker head 110 made, for example, of concrete is equipped with a central canal through which the tube 14 of the anchoring stake 10 passes. The head plate 22 is housed in a cavity 112 of the marker head 110. A plastic plug 114 seals this cavity 112 and the opening in the head plate 22 of the tube 14. It is held in place by compression ribs 116 and has a centering cavity 118 for sight glasses, surveying poles or prisms (not shown).

Figure 11:
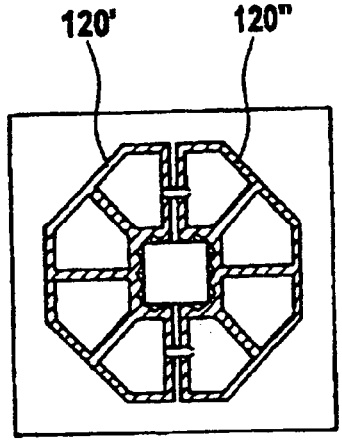
FIG. 11: a section through the ground-firming cone.

The anchoring stake 10 of FIG. 10 further comprises a plastic ground-firming body 120 improving the stability of the ground anchor point. This body has the shape of an inverted cone or of an inverted pyramid equipped with a central canal for the passage of the tube 14. In FIG. 11 it can be seen that the ground-firming body 120 is formed of two half-bodies 120', 120" assembled along a central plane around the tube 14.

Figure 12:
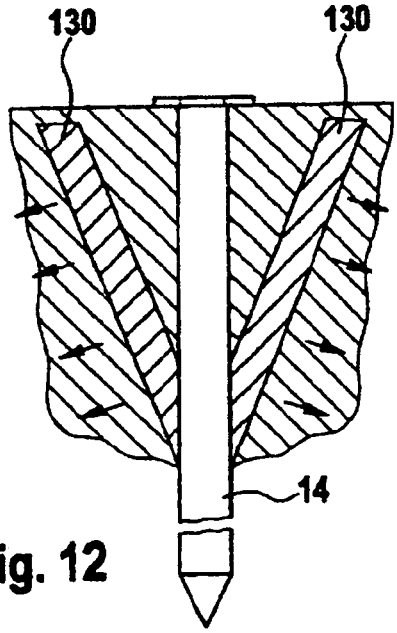
FIG. 12: a schematic view in vertical section showing an anchoring stake equipped with ground-firming section pieces.
Figure 13:
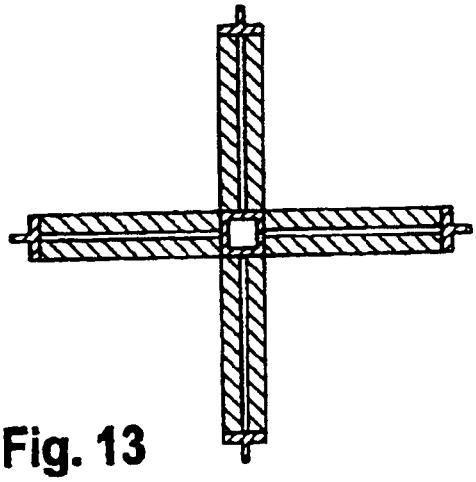
FIG. 13: a horizontal section through the anchoring stake of FIG. 12.

The anchoring stake 10 in FIGS. 12 and 13 comprises four T-sections 130 extending at an angle along the upper part of the tube 14 toward the upper end thereof so as to form a "V" in two orthogonal planes. These T-sections 130 also act as ground-firming means at the upper end of the tube 14, to give the ground anchor point better stability.

The invention claimed is:

1. A system for anchoring an object in the ground comprising:

a stake including:

a tube with at one end a drive-in spike and at the other end a tube head, said tube having a tube wall and being conceived to be inserted with its drive-in spike first, along a drive-in direction into the ground;

a central support rod which is axially arranged within said tube, wherein it is axially guided in translation and prevented from rotating, said central rod having an upper end near said head of said tube and a lower end near said drive-in spike of said tube, said upper end being equipped with a first coupling means;

at least two deformable anchoring claws, each of said anchoring claws having one end which is borne by said lower end of said central support rod and another end passing through a through opening in said tube wall near said drive-in spike, said through openings having a geometry such that they cause said anchoring claws to deploy at an angle along said tube in the opposite direction to said drive-in direction when an axial traction is exerted on said central support rod in the opposite direction to said drive-in direction; and means for employing said anchoring stake including:

a threaded rod for exerting said axial traction on said central support rod, said threaded rod including a first end and a second end, said first end being equipped with a second coupling means able to collaborate with said first coupling means at said upper end of said central support rod; and a nut screwed on said second end of said threaded rod, wherein, for exerting said axial traction on said central support rod in the opposite direction to said drive-in direction, said second coupling means is coupled to said first coupling means equipping said upper end of said support rod, and said nut screwed on said upper end of said threaded rod is rotated in a first direction while it bears on said tube head.

2. The system as claimed in claim 1, wherein said means for employing said anchoring stake further include:

a locking means connected to said tube head in such a way as to form a backstop for said nut when the latter is turned in a second direction, opposite to said first direction, in order thus to cause a translational movement of said threaded rod toward the inside of said tube and cause said claws to retract back inside said tube.

3. The system as claimed in claim 2, wherein said locking means is an element that can be removably connected to said tube head.

4. The system as claimed in claim 3, wherein:

said nut comprises a base;

said tube head comprises a collar; and said locking means is a stirrup piece straddling said base and said collar.

5. The system as claimed in claim 1, wherein said first and second coupling means form a coupling with a helical connection or a bayonet connection.

6. The system as claimed in claim 1, wherein said anchoring claws are deformable rods.

7. The system as claimed in claim 6, wherein said tube has a square cross section with four corners, said central support rod has a round cross section, and said anchoring claws are deformable rods of round cross section which are arranged in said corners of said tube, said through openings for said deformable rods being arranged in said corners.

8. The system as claimed in claim 1, wherein through openings for said deformable anchoring claws are located at different heights from said drive-in spike.

9. The system as claimed in claim 8, wherein said anchoring claws are borne by a plate fixed to said lower end of said central support rod and have different lengths.

10. The system as claimed in claim 1, wherein said lower end and said upper end of said central support rod are axially guided in said tube.

11. The system as claimed in claim 1, further comprising ground-firming means arranged around said tube at said tube head end.

12. The system as claimed in claim 11, wherein said ground-firming means comprises a body in the form of an inverted cone or of an inverted pyramid, provided with a central canal through which said tube can pass.

13. The system as claimed in claim 12, wherein said body is formed of two half-bodies assembled along a central plane.

14. The system as claimed in claim 11, wherein said ground-firming means comprise at least two T sections extending at an angle along the upper part of said tube so as to form a "V".

15. The system as claimed in claim 1, wherein said means for employing said anchoring stake further include a mandrel equipped with a shoulder able to bear against a collar surrounding said tube head in order to drive said tube into the ground, and equipped with a central rod with a supple end able to bear against the upper end of said central support rod in order to drive the latter into said tube and thus retract said claws.

16. The system of claim 1, wherein said object is a land-survey bench-mark.

17. A method for anchoring an object in the ground comprising the steps of:

providing a stake including:

a tube with at one end a drive-in spike and at the other end a tube head, said tube having a tube wall and being conceived to be inserted with its drive-in spike first, along a drive-in direction into the ground;

a central support rod which axially arranged within said tube, wherein it is axially guided in translation and prevented from rotating, said central rod having an upper end near said head of said tube and a lower end near said drive-in spike of said tube, said upper end being equipped with a first coupling means;

at least two deformable anchoring claws, each of said anchoring claws having one end which is borne by said lower end of said central support rod and another end passing through a through opening in said tube wall near said drive-in spike, said through openings having a geometry such that they cause said anchoring claws to deploy at an angle along said tube in the opposite direction to said drive-in direction when an axial traction is exerted on said central support rod in the opposite direction to said drive-in direction;

driving said stake with its drive-in spike first, along a drive-in direction into the ground;

providing a threaded rod including:

a first end and a second end, a second coupling means at said first end, said second coupling means being capable of being coupled to said first coupling means; and a nut screwed on said second end of said threaded rod, said nut being capable of bearing on said tube head;

coupling said second coupling means of said threaded rod to said first coupling means of said support rod; and rotating said nut bearing on said tube head in a first direction, so that it lifts said threaded rod out of said tube, whereby an axial traction in the opposite direction to said drive-in direction is exerted on said central support rod and said anchoring claws are caused to deploy along said tube in the opposite direction to said drive-in direction.

* * * * *